US005427549A

United States Patent [19]

Smith et al.

[11] Patent Number: 5,427,549

[45] Date of Patent: Jun. 27, 1995

[54] ELECTRICAL CABLE ASSEMBLY WITH IMPROVED LATCH

[75] Inventors: Lisa A. Smith, Harrisburg; David K. Eisentraut, Hummelstown; Michael S. Leonzo; Rodd R. Ruland, both of Harrisburg, all of Pa.

[73] Assignee: The Whitaker Corporation, Wilmington, Del.

[21] Appl. No.: 310,119

[22] Filed: Sep. 21, 1994

[51] Int. Cl.[6] ..... H01R 13/502

[52] U.S. Cl. ..... 439/701; 439/736; 439/101; 439/594

[58] Field of Search ..... 439/701, 350, 352, 353, 439/354, 357, 358, 695, 696, 552–555, 736, 686, 101, 594

[56] References Cited

U.S. PATENT DOCUMENTS

| | | | |
|---|---|---|---|
| 3,678,439 | 7/1972 | Vetter . | |
| 3,793,685 | 2/1974 | Knecht | 24/230 |
| 4,214,802 | 7/1980 | Otani et al. . | |
| 4,261,628 | 4/1981 | Gallagher et al. . | |
| 4,316,647 | 2/1982 | Bailey et al. . | |
| 4,586,769 | 5/1986 | Tengler et al. . | |
| 4,586,776 | 5/1986 | Ollis et al. . | |
| 4,610,496 | 9/1986 | Schwartz et al. . | |
| 4,626,054 | 12/1986 | Tengler et al. | 439/594 |
| 4,762,505 | 8/1988 | Asick et al. | 439/347 |
| 4,764,130 | 8/1988 | DiClemente | 439/701 |
| 4,824,386 | 4/1989 | Souders | 439/133 |
| 5,046,956 | 9/1991 | Takano | 439/553 |
| 5,352,133 | 10/1994 | Sampson | 439/701 |

*Primary Examiner*—Larry I. Schwartz
*Assistant Examiner*—Hien D. Vu

[57] ABSTRACT

An electrical cable and organizer assembly (10) with an improved latch (50) is disclosed. The connector (20) includes contacts (16, 18) that are terminated to the conductors (22) of the cable (14), and a connector housing (20) that is overmolded so that it surrounds the entire end (30) of the cable and the leads of the contacts (16, 18). A plurality of these cables (14) and attached connectors (20) are arranged within side by side cavities (80) in an organizer (12) and releasable latched in place. The latch (50), a separate part attached to each connector, includes a convex surface ( 62 ) that latchingly engages an opening ( 90 ) in the top wall of the organizer. By depressing the convex surface (62) of the latch member (50) the cable and associated connector are released and can be removed from the organizer (12). The latch member includes an elastic beam (56) that allows sufficient deflection to release the latch while maintaining the beam within its elastic limit.

10 Claims, 5 Drawing Sheets

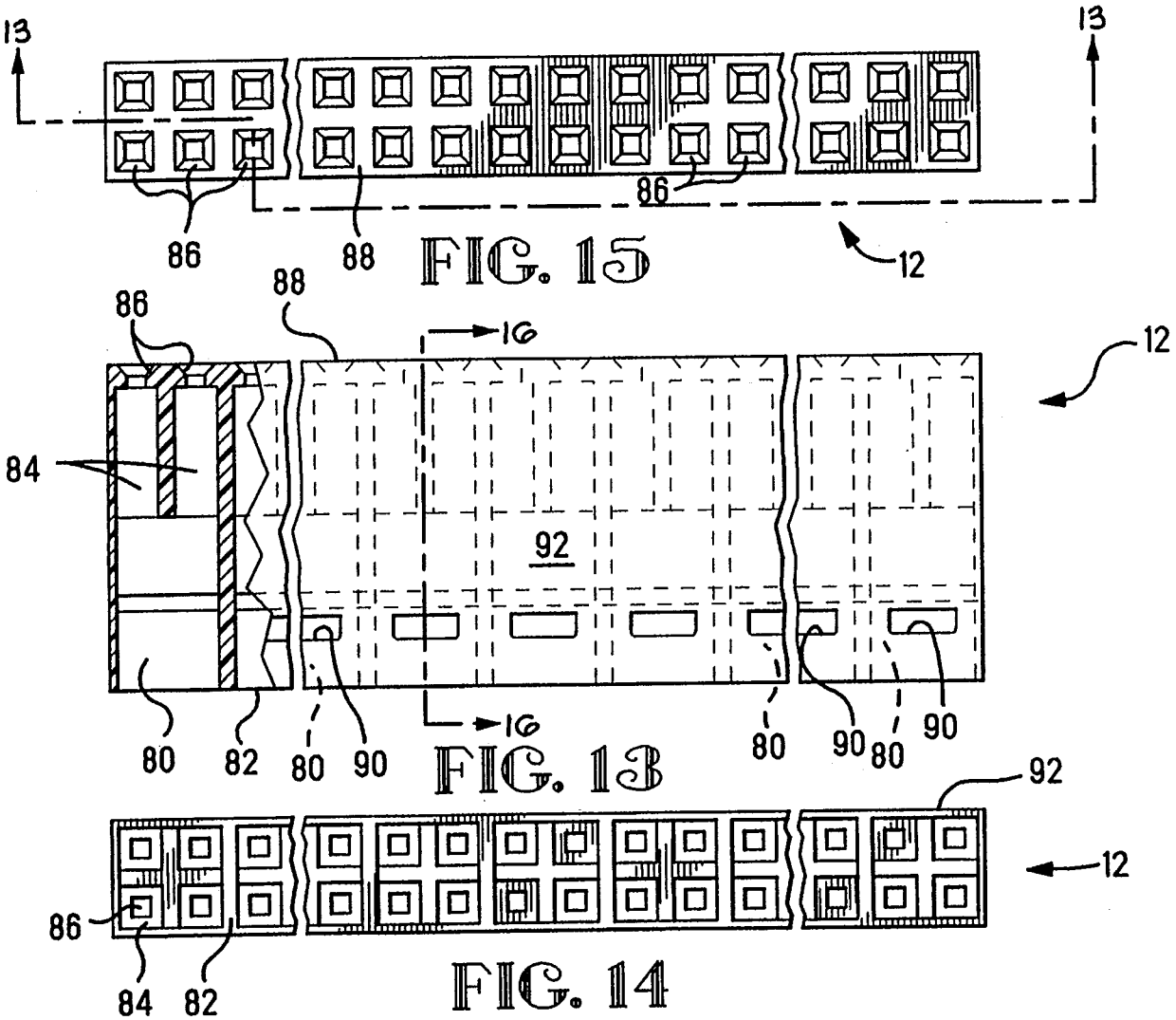
FIG. 15
FIG. 13
FIG. 14
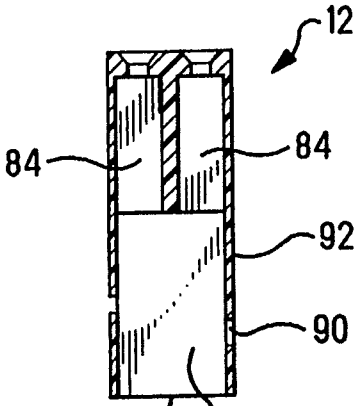
FIG. 16

ELECTRICAL CABLE ASSEMBLY WITH IMPROVED LATCH

The present invention relates to electrical cable assemblies having a connector terminated to one end thereof, the connector being latched in an organizer along with other such connectors and more particularly to an improved latch for releasably securing the connector to the organizer.

BACKGROUND OF THE INVENTION

In point to point wiring, such as in high density electronic equipment having signal carrying multiple coaxial cables, for example, the individual cables are terminated to miniature connectors which are arranged in organizers at their respective destinations. The organizers are made of plastic and have relatively thin walls, while the connectors are overmolded to the terminated end of the cable. Each connector includes a molded latch that engages a feature in the organizer when the connector is inserted thereinto that secures the connector in place. The organizers are dimensioned so that they may be placed side by side or stacked while maintaining the center to center distance between contacts in both the vertical and horizontal directions. This requires that the walls of the organizers be relatively thin and, therefore, somewhat fragile. Should the connector be removed, for maintenance for example, the latch is usually rendered inoperative. This is due to scoring or breaking of the relatively soft, thin wall of the organizer that is adjacent the latch or the latch itself breaks away from the overmolded connector housing. Such a connector with integral molded latch is disclosed in U.S. Pat. No. 4,586,776 which issued May 6, 1986 to Ollis et. al. The '776 patent discloses a pair of side by side contacts extending from an insulating connector housing, the housing having a pair of catch protrusions molded in opposite sides thereof. An organizer housing is arranged for receiving the contacts and the end of the connector housing having the protrusions, openings being in the walls of the organizer to latchingly receive the protrusions. In order to remove the connector housing from the organizer, the walls of the organizer must be sufficiently deflected to allow the protrusions to pass. This usually damages the thin walls of the organizer or breaks one or both of the protrusions, rendering the assembly unusable. On the other hand, U.S. Pat. No. 4,586,769 which issued May 6, 1986 to Tengler et. al. discloses a pair of contacts extending from a connector housing arranged to be latchingly received in an organizer housing. The connector housing has a molded catch protrusion extending from a somewhat deflectable portion of the connector housing having a camming surface for effecting deflection thereof. The protrusions latchingly engage features in the interior of the organizer. When it is desired to remove the connector housing from the organizer, a tool is inserted through an access hole into engagement with the camming surface, the deflectable portion of the connector housing is then deflected and the connector housing removed. Such a structure relies on the inherent elasticity of the connector housing which may be insufficient when dealing with very small compact parts.

What is needed is a small compact connector housing having a separate deflectable latch member that is attached to the connector housing. The deflectable latch member includes an elastic beam that allows sufficient deflection to release the latch while maintaining the beam within its elastic limit.

SUMMARY OF THE INVENTION

An electrical cable assembly is disclosed including an electrical cable having a plurality of conductors. A plurality of contacts are provided, each of which has a lead connected to a respective one of the plurality of conductors at a point of connection. An insulating connector housing is molded in situ about the conductors and the leads at the points of connection. The connector housing has a recess in a side wall thereof and a first opening within the recess. An insulating organizer has an interior cavity shaped to receive the contacts and a portion of the connector housing when the connector housing is in mated engagement with the organizer. A second opening is formed through a first wall of the organizer in alignment with the recess and intersecting the cavity. A latch member, separate from the connector housing, includes a catch, a resilient beam extending from the catch, and a shank at the end of the beam. The shank extends into the first opening and is an interference fit therein and is arranged so that the catch is partially within the recess and in latching engagement with the first wall adjacent the second opening thereby holding the connector housing in mated engagement with the organizer.

DESCRIPTION OF THE FIGURES

FIGS. 13, 14, 15, and 16 are plan, rear, front, and side views, respectively, of the organizer shown in FIG. 1.

DESCRIPTION OF THE PREFERRED EMBODIMENT

Figure 1:
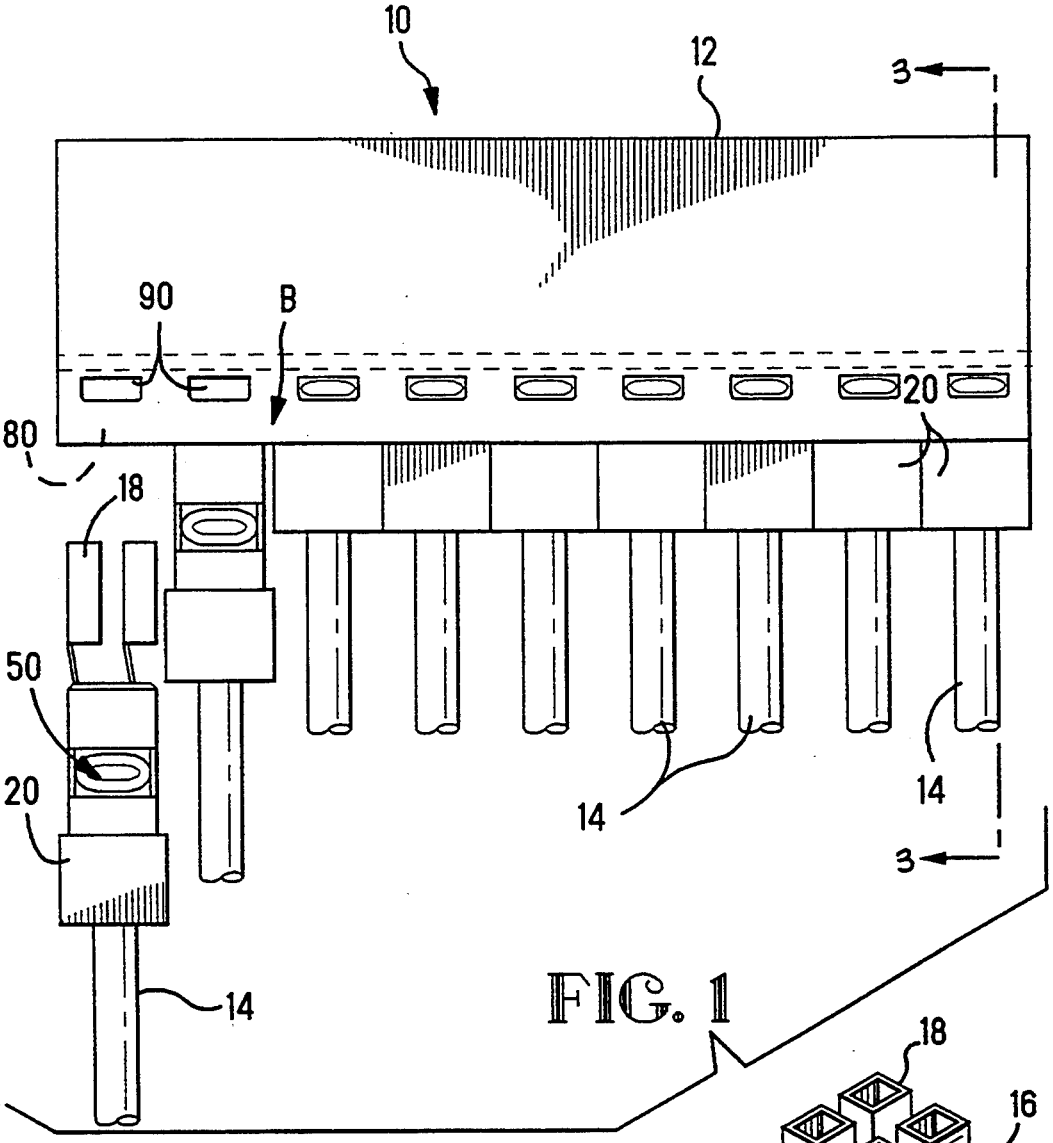
FIG. 1 is a plan view of a cable assembly incorporating the teachings of the present invention.
Figure 2:
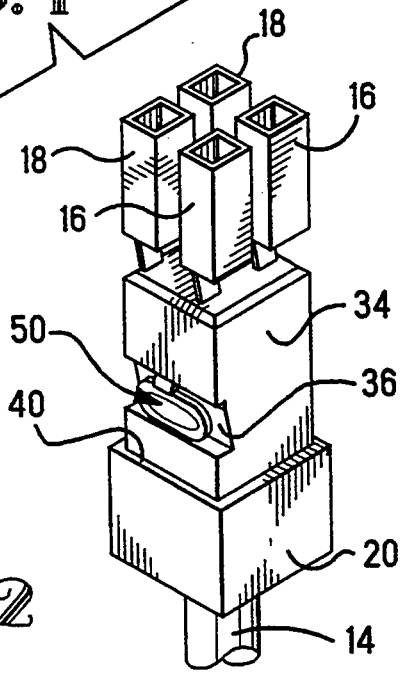
FIG. 2 is an isometric view of a molded connector housing with associated contacts and cable.
Figure 8:
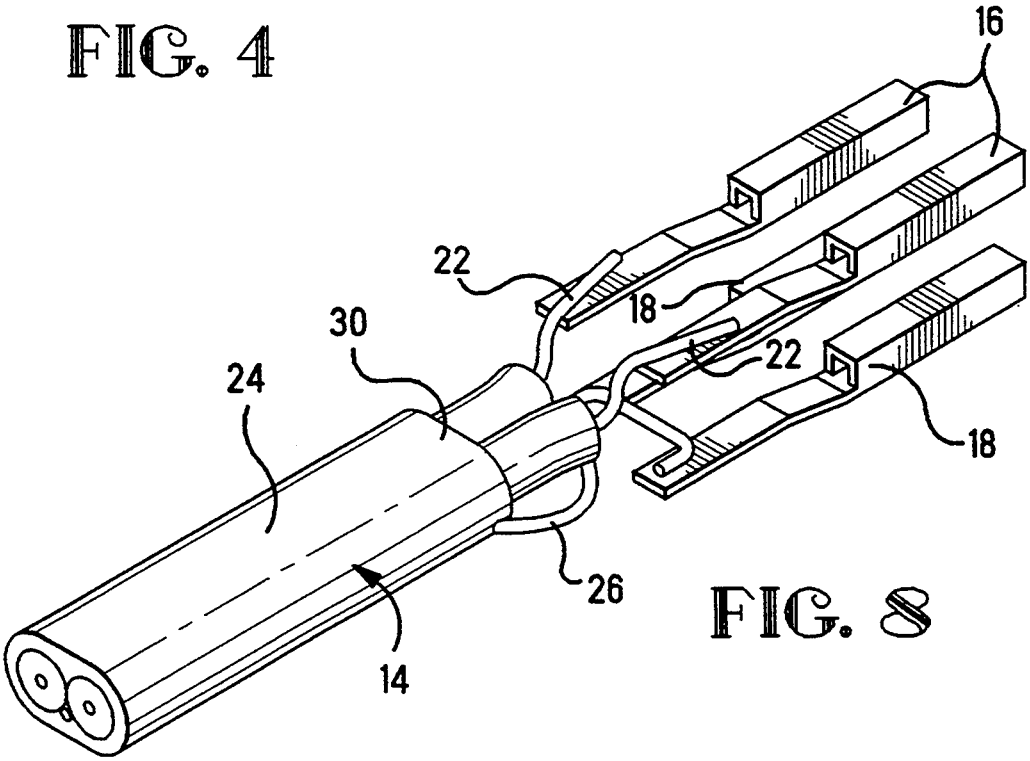
FIG. 8 is a schematic representation of the interconnection of the conductors of the cable and contacts shown in FIG. 6.
Figure 6:
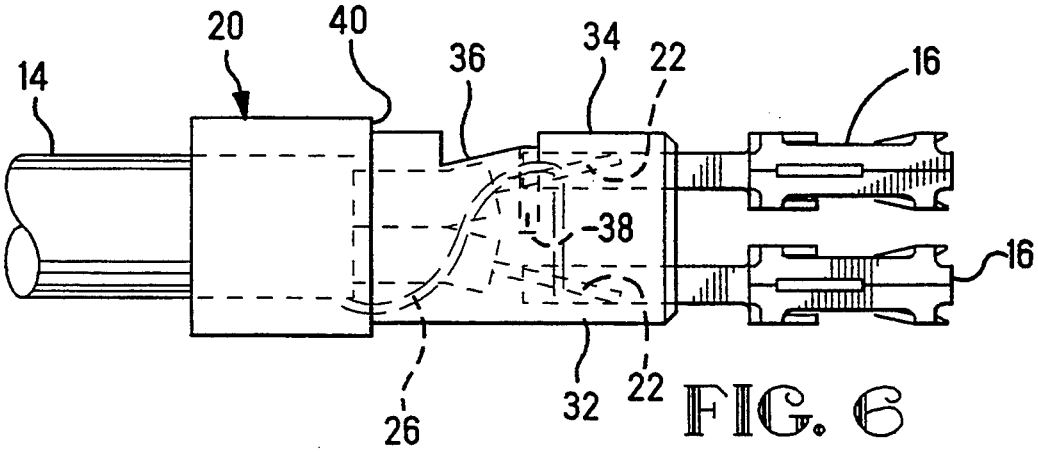

There is shown in FIG. 1 a cable assembly 10 including a cable organizer housing 12 and a plurality of terminated cables 14 arranged in mated engagement with the organizer. Note that two of the cables, as shown, are not fully mated. Each of the cables 14 is terminated with two signal contacts 16 and two ground contacts 18, all of which are receptacle contacts, as shown in FIG. 2. An insulating housing 20 is overmolded in situ about the end of the cable 14 and the leads of the attached receptacle contacts 16 and 18. As shown in FIG. 8, the cable 14 has a pair of insulated signal conductors 22 surrounded by a conductive shield layer 24 to form a coaxial cable. The two signal conductors 22 are electrically attached to the leads of the two signal contacts 16, in the present example, by resistance welding. The shield layer 24 is electrically connected to the lead of both of the contacts 18 by means of a drain conductor 26. Further, it will be understood that the teachings of the present invention may be advantageously utilized with cables having fewer or more conductors and where the conductors are interconnected to fewer or more contacts in various configurations. As shown in FIG. 6, the molded connector housing 20 completely encloses the stripped portions of the conductors 22, 26, and 28 and their attachment points with the leads of the contacts as well as a portion 30 of the jacketed end of the cable 14.

Figure 5:
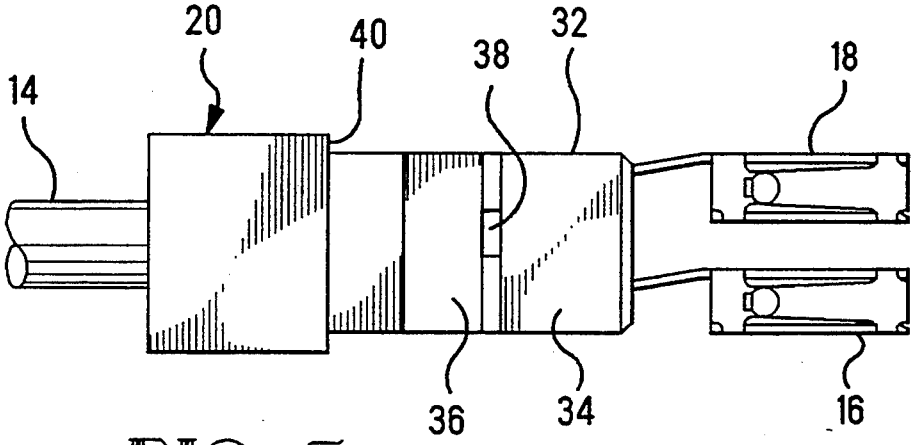
FIGS. 5, 6, and 7 are top, side, and end views, respectively, of a molded connector housing as shown in FIG. 2.
Figure 7:
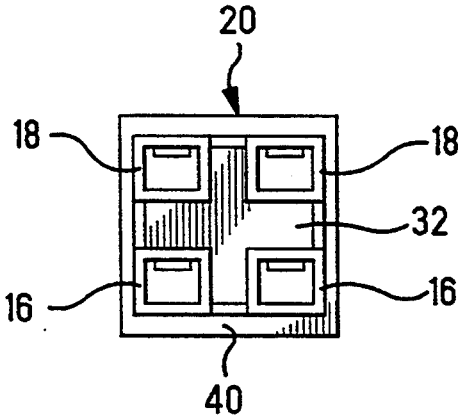
Figure 10:
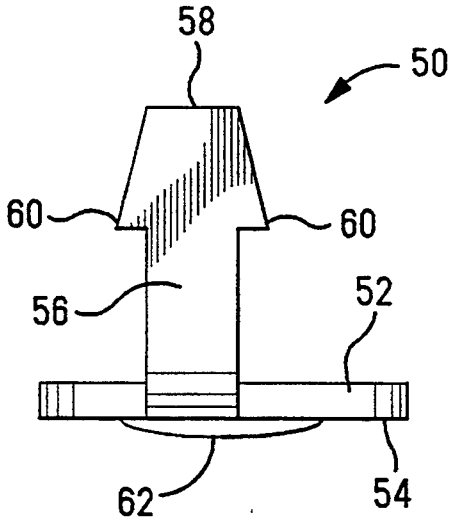
FIGS. 9, 10, and 11 are top, side, and end views, respectively, of the latch member shown in FIGS. 2 and 3.
Figure 9:
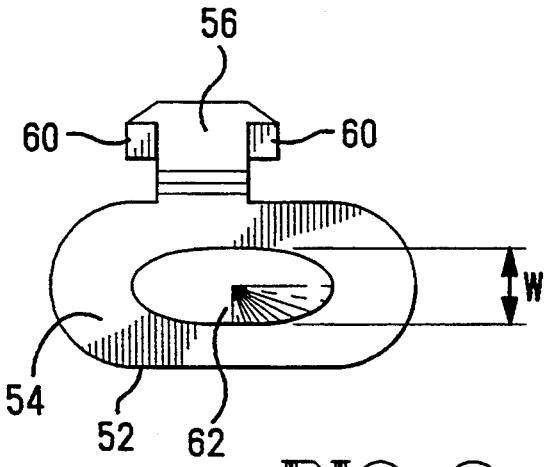
Figure 11:
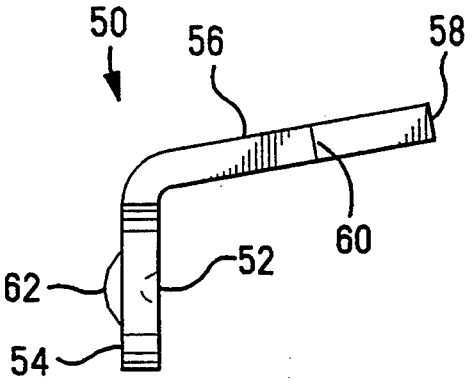
Figure 12:
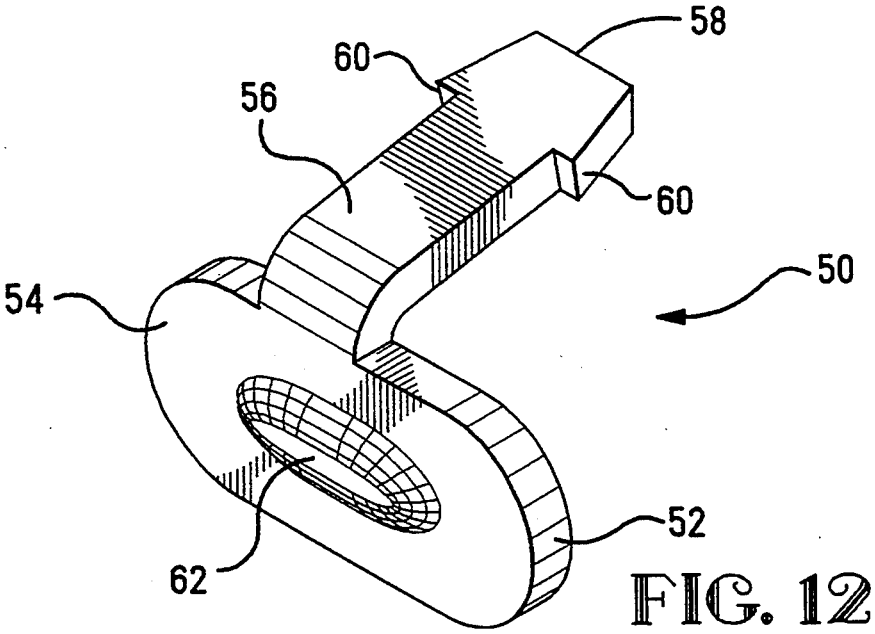
FIG. 12 is an isometric view of the latch member shown in FIGS. 9, 10, and 11.

As shown in FIGS. 5, 6, and 7, the molded connector housing 20 has an end portion 32 having a rectangular cross-section. A side 34 of the end portion 32 includes a recess 36 formed therein, as best seen in FIG. 6. An opening 38 is formed in the floor of the recess and extends into the interior of the connector housing 20 between the leads of the contacts 16 and 18 and the conductors 22, 26, and 28. The purpose of the opening 38 and recess 36 will be explained below. The end portion 34 terminates in a shoulder 40 which limits the depth of insertion of the connector housing 20 into the organizer 12.

Figure 3:
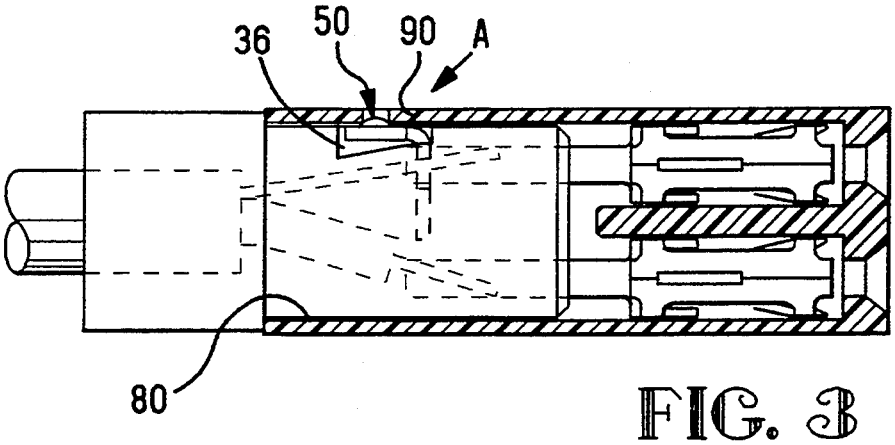
FIG. 3 is a cross-sectional view taken along the lines 3—3 in FIG. 1 showing only the organizer in cross-section.
Figure 4:
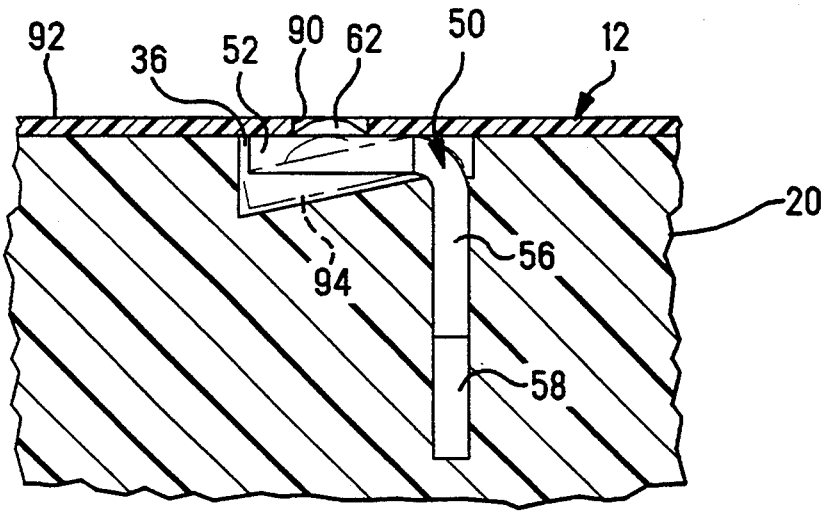
FIG. 4 is an enlarged view of a portion of FIG. 3 indicated by the arrow A.

As shown in FIGS. 3 and 4, a latch member 50 is disposed within the recess 36 of the connector housing 20. The latch member 50, as best seen in FIGS. 9 through 12, includes a catch 52 having a relatively flat surface 54 that is somewhat oval shaped. A resilient beam 56 extends from the catch 52 at a right angle bend so that the beam is substantially perpendicular to the flat surface 54. The beam 56 terminates in a shank 58 having barbs 60 on opposite sides thereof. A convex surface 62 projects from the flat surface 54 and has a specific width indicated by W in FIG. 9, for a purpose that will be described. The shank 58 is disposed within the opening 38, which is an interference fit with the shank, so that the barbs 60 bite into the sides of the opening, securely holding the latch member within the recess 36, as shown in FIGS. 2, 3 and 4. The latch member 50 is made of any suitable spring material such as, for example, stainless steel or phosphorus bronze, so that the beam 56 and the right angle bend are sufficiently elastic to permit deflection of the catch 52, as will be described.

The organizer 12, as best seen in FIGS. 13 through 16, includes a number of cavities 80, arranged side by side, that are shaped and sized to closely but freely receive the end portion 32 of the connector housing 20 until the shoulder 40 abuts an outer edge 82 of the organizer, as shown in FIG. 3. Each cavity 80 includes four additional cavities 84 arranged to receive and guide the four receptacle contacts 16 and 18. A chamfered opening 86 is formed through the front wall 88 of the organizer 12 in axial alignment with each contact cavity 84, for receiving a pin contact of a mating electrical connector. A number of rectangular shaped openings 90 are formed through a top wall 92 of the organizer so that an opening is vertically over each respective cavity 80, as viewed in FIG. 13, and intersects the cavity. Each opening 90 has a length that is slightly longer than the length of the convex surface 62 and a width that is substantially equal to the width W of the convex surface. The walls of the organizer are sized so that when two or more organizers 12 are vertically stacked or are arranged side by side, neither configuration is shown, the center to center distance between the chamfered openings 86, in both the vertical and horizontal directions, is substantially identical. In the present example the cavity 80 is about 0.172 inch square and the outer walls, the sides, top, and bottom, have a nominal thickness of about 0.013 inch. The center to center distance of the openings 86 is about 0.100 inch. As will be appreciated by those skilled in the art, such a small delicate structure leaves little room for conventional latching structures that are releasable.

In operation, as best seen in FIGS. 1, 3, and 4, the cable 14 and attached connector housing 20 are aligned with a desired cavity 80 with the latch member 50 facing upwardly. The receptacle contacts 16 and 18 and the end portion 34 are partially inserted into the cavity 80 with the contacts just entering the contact cavities 84, as shown by the arrow B in FIG. 1. The latch member 50 is then depressed into the opening 90 to the position shown in phantom lines at 94 in FIG. 4, and held in this position while the cable and connector housing is further inserted into the cavity 80. As the convex surface 62 engages the edge 82 of the organizer it cams downwardly and slides along the under surface of the top wall 92 until the shoulder 40 abuts the outer edge 82. At this point the resiliency of the beam 56 causes the convex surface 62 to snap into the opening 90, as shown in solid lines in FIG. 4, thereby latching the connector housing 20 into mated position in the organizer 12, as shown in FIG. 3. The cable 14 and attached connector housing 20 may be removed from the organizer 12 by simply depressing the convex surface 62 of the latch member 50 to the position shown in phantom lines at 94 in FIG. 4 and the cable and connector housing gently pulled outwardly. The convex surface 62 cams downwardly deflecting the beam 56 and rides along the under surface of the top wall 92 until it clears the cavity 80.

An important advantage of the present invention is that a small compact connector housing and organizer assembly is provided having a separate deflectable latch member that is attached to the connector housing. This provides the ability to release the connector housing from the organizer for repair or replacement and then subsequent mating and relatching. The deflectable latch member latches to the relatively thin wall of the organizer without adversely affecting the wall thereof.

We claim:

1. An electrical assembly comprising:

(a) an electrical cable having a plurality of conductors;

(b) a plurality of contacts, each of which has a lead connected to a respective one of said plurality of conductors at a point of connection;

(c) an insulating connector housing molded in situ about said conductors and said leads at said points of connection, said connector housing having a recess in a side wall thereof and a first opening within said recess;

(d) an insulating organizer having an interior cavity shaped to receive said contacts and a portion of said connector housing when said connector housing is in mated engagement with said organizer, said organizer having a second opening extending through a first wall at an end of said organizer in alignment with said recess and intersecting said cavity; and (e) a latch member positioned in said recess and being separated from said connector housing, said latch member ncluding a catch, a resilient beam extending from said catch, and a shank including barbs at the end of said beam extending into said first opening and being an interference fit therein and arranged so that said catch is partially within said recess and in latching engagement with said first wall adjacent said second opening thereby holding said connector housing in said mated engagement with said organizer.

2. The assembly according to claim 1 wherein said insulating organizer is arranged to receive said contacts and said portion of a plurality of said connector housings arranged side by side in mated engagement with said organizer.

3. The assembly according to claim 1 wherein said portion of said connector housing is of generally rectangular cross-section having flat sides and said recess is in one of said flat sides.

4. The assembly according to claim 3 wherein said catch has a generally flat surface with a projection extending outwardly therefrom, and wherein said resilient beam is joined to said catch so that when said projection is depressed and is urged completely into said recess, said projection disegaged from first wall adjacent said second opening thereby releasing said connector from said latching engagement with said organizer.

5. The assembly according to claim 4 wherein said projection is a substantially convex surface.

6. The assembly according to claim 5 wherein said plurality of contacts are four receptacle contacts arranged in a two by two array.

7. An electrical cable assembly comprising:

(a) an electrical cable having a plurality of conductors;

(b) a plurality of receptable contacts, each of which has a lead connected to a respective one of said plurality of conductors at a point of connection;

(c) an insulating connector housing molded in situ about said conductors and said leads at said points of connection, said connector housing having a recess in a side wall thereof and a first opening within said recess; and (d) a latch member positioned in said recess and being seperated from said connector housing, said latch member including a catch, a resilient beam extending from said catch, and a shank including barbes at the end of said beam extending into said first opening and being an interference fit therein, wherein said connector housing is matingly engaged with an organizer having an interior cavity shaped to receive said contacts and a portion of said connector housing when said connector housing is in mated engagement with said organizer, said organizer having a second opening extending through a first wall at an end thereof in alignment with said recess and intersecting said cavity, and wherein said catch is partially positioned within said recess and adapted to be in latching engagement with said first wall adjacent said second opening for holding said connector housing in said mated engagement with said organizer.

8. The cable assembly according to claim 7 wherein said portion of said connector housing is of generally rectangular cross-section having flat sides and said recess is in one of said flat sides.

9. The cable assembly according to claim 8 wherein said catch has a generally flat surface with a projection extending outwardly therefrom, and wherein said resilient beam is joined to said catch so that when said projection is depressed and is urged completely into said recess, said projection will disengage from said second opening said first wall of said organizer.

10. The cable assembly according to claim 9 wherein said projection is a substantially convex surface.

* * * * *